US006071851A

United States Patent [19]

Wakamatsu

[11] Patent Number: 6,071,851

[45] Date of Patent: Jun. 6, 2000

[54] HEAT-SENSITIVE RECORDING MATERIAL AND METHOD FOR PRODUCING SAME

[75] Inventor: Kiichiro Wakamatsu, Tokyo, Japan

[73] Assignee: Mitsubhishi Paper Mills Limited, Tokyo, Japan

[21] Appl. No.: 09/043,150

[22] PCT Filed: Aug. 7, 1997

[86] PCT No.: PCT/JP97/02761

§ 371 Date: Mar. 13, 1998

§ 102(e) Date: Mar. 13, 1998

[87] PCT Pub. No.: WO98/06589

PCT Pub. Date: Feb. 19, 1998

[30] Foreign Application Priority Data

Aug. 8, 1996 [JP] Japan ..... 8-209654

[51] Int. Cl.[7] ..... B41M 5/30; B41M 5/40

[52] U.S. Cl. ..... 503/200; 503/207; 503/226

[58] Field of Search ..... 427/152; 503/200, 503/226, 207

[56] References Cited

FOREIGN PATENT DOCUMENTS

| | | | |
|---|---|---|---|
| 359 419 | 8/1989 | European Pat. Off. . | |
| 5-139035 | 6/1993 | Japan | 503/226 |
| 6-340174 | 12/1994 | Japan | 503/201 |
| 7-323661 | 12/1995 | Japan . | |
| 9-031138 | 2/1997 | Japan . | |

*Primary Examiner*—Bruce H. Hess
*Attorney, Agent, or Firm*—Pillsbury Madison & Sutro LLP

[57] ABSTRACT

The present invention provides a heat-sensitive recording material high in sensitivity and whiteness. That is, a heat-sensitive recording material which comprises a support and a recording layer between which an intermediate layer is provided and which is of high sensitivity could be obtained by using a latex having a temperature-sensitive gelling characteristic as a binder of the intermediate layer and by adjusting pH of a coating solution of the intermediate layer to 7.0 or more, and adjusting temperature of the coating solution at the time of preparation and coating to a temperature lower at least 20° C. than the gelling temperature of the temperature-sensitive latex. Furthermore, a heat-sensitive recording material of high whiteness and very high printability could be obtained by adding a non-crosslinking type acrylic alkali thickening agent to the coating solution of the intermediate layer.

9 Claims, No Drawings

HEAT-SENSITIVE RECORDING MATERIAL AND METHOD FOR PRODUCING SAME

This application is the national phase of international application PCT/JP97/02761 filed Aug. 7, 1997 which designated the U.S.

TECHNICAL FIELD

The present invention relates to a heat-sensitive recording material and a method for producing the same. More particularly, it relates to a method for producing a heat-sensitive recording material which provides a recording material high in sensitivity and whiteness, having high print image reproducibility and less in formation of detritus at the time of recording and, furthermore, it relates to a method for producing a high-quality and inexpensive heat-sensitive recording material having an intermediate layer superior in film properties which is less in formation of streak at the time of coating, less in change in properties of viscosity of coating solution and can assure stable operation.

BACKGROUND ART

Heat-sensitive recording materials have the merits in that color images can be obtained only by heating, and recording devices are relatively simple and compact, and they are widely utilized as recording papers for various information. Recently, especially heat-sensitive facsimiles and printers are improved to make it possible to carry out high-speed recording which has been difficult to perform. With such increase in recording speed in the field of devices and hardwares, the heat-sensitive recording materials used are required to have improved recording sensitivity, and various proposals have been made therefor. These heat-sensitive recording materials generally comprise a support such as paper, plastic film, or synthetic paper and, provided thereon, a color forming layer of single- or multi-layer mainly composed of adhesives and heat color-forming materials.

For obtaining heat-sensitive recording materials high in sensitivity and high in quality of images formed thereon, there have been proposed to provide an intermediate layer comprising a oil-absorbing pigment to form voids (JP-A-59-155097, JP-A-61-44683) and to employ an intermediate layer of multi-layer to improve smoothness and heat insulation (JP-A-61-11286, JP-A-61-193880).

Furthermore, a recording sheet has been proposed which has an intermediate layer comprising fine hollow particles in addition to the oil-absorbing pigment (JP-A-59-5093). The intermediate layer mainly composed of these organic or inorganic pigments has a high effect, and especially when fine hollow particles are used, since they are lower in thermal conductivity than the generally used oil-absorbing inorganic pigments, very high print image reproducibility can be obtained, but no comprehensive research on binders used for binding the intermediate layer and the support has been made, and, as a result, no satisfactory intermediate layer has been obtained. For example, it has been shown to use water-soluble polymers such as starch, casein, PVA, methylcellulose, carboxymethylcellulose, hydroxyethylcellulose and polyacrylic acid, and various synthetic resin emulsions such as styrene-butadiene copolymer, acrylonitrile-butadiene copolymer, colloidal silica particles-containing styrene-acrylate copolymer and acrylic acid copolymer. However, when an intermediate layer is formed using one or more of these binders, a part of the voids in the resulting intermediate layer are filled up with the binder, and heat insulation is damaged and no sufficient effect to increase sensitivity can be obtained. As a result, heat-sensitive recording materials provided with a high print image reproducibility have not yet been obtained.

JP-A-9-25454 discloses gelled latices for coating, but when they are used together with pigments, gelation occurs or properties of coating solution such as viscosity is unstable and they cannot be stably used.

Further methods have been proposed which include forming on a support a layer comprising foaming plastic fillers (JP-A-59-225987) or thermally expansible fine hollow particles and further providing thereon a layer comprising organic or inorganic pigments (JP-A-64-8088). However, though multilayer coating of the intermediate layer improves thermal recording sensitivity, this is not suitable for production methods of low cost and much consumption type from the point of operability.

Furthermore, attempts to improve contact with thermal head and increase recording sensitivity have been made by enhancing smoothness by cast coating the intermediate layer (JP-A-54-83841, JP-A-56-21889) or by improving smoothness by supercalendering (JP-B-56-86792). However, cast-coating is not suitable for production methods of low cost and much consumption type and supercalendering causes rupture of voids in the layer to damage the heat insulation required for intermediate layer.

Furthermore, for the production of intermediate layer, use of coating solution containing non-crosslinking type alkaline acrylic thickening agent in the case of using calcined clay as pigment has been proposed (JP-A-2-69287). However, pH of coating solutions containing calcined clay or amorphous silica is in the weak acidic region and when an alkali thickening agent is added as it is, action of thickening agent is not sufficiently exhibited and viscosity of the solution becomes unstable. Therefore, in the case of blade coating, pressure applied by the blade varies to cause change in coating amount or formation of streaks on the coating layer. Thus, coating solutions suitable for blade coating can hardly be obtained and, besides, the inherent effect of the intermediate layer cannot be sufficiently obtained.

Generally, an overcoat layer is provided for preventing color formation due to rubbing with fingers (scratch resistance) or decoloration of the images due to solvent or the like. However, when such overcoat layer is provided, the effect of the intermediate layer is not sufficiently exhibited.

The object of the present invention is to provide a method for producing a heat-sensitive recording material which provides a recording material high in sensitivity and whiteness, having high print image reproducibility and less in formation of detritus at the time of recording and, furthermore, a method for producing a high-quality and inexpensive heat-sensitive recording material having an intermediate layer superior in film properties which is less in formation of streak at the time of coating, less in change in viscosity characteristics of coating solution and can assure stable operation.

DISCLOSURE OF INVENTION

The inventors have accomplished the present invention by the heat-sensitive recording materials of the following construction to solve the above-mentioned problems. That is, the present invention relates to the following (1)–(7).

(1) A heat-sensitive recording material comprising a support and, provided thereon, a heat-sensitive recording layer mainly composed of a colorless or light-colored basic dye and a color developer capable of reacting with the dye to form a color, an intermediate layer containing an inorganic or organic pigment being provided between the support and the recording layer, characterized in that a binder of the intermediate layer contains a latex having a characteristic of gelling at a certain temperature (temperature-sensitive gelling characteristic) and a coating solution of the intermediate layer has a pH of 7.0 or more at the time of being coated.

(2) A heat-sensitive recording material of (1), characterized in that the intermediate layer contains 0.05–5 parts by weight of an acrylic alkali thickening agent for 100 parts by weight of the pigment in the intermediate layer.

(3) A heat-sensitive recording material of (1) or (2), characterized in that the pigment in the intermediate layer comprises fine hollow particles.

(4) A heat-sensitive recording material of (1), (2) or (3), characterized in that at least one overcoat layer is provided on the heat-sensitive recording layer.

(5) A method for producing a heat-sensitive recording material which comprises providing an intermediate layer on a support and providing thereon a heat-sensitive recording layer mainly composed of a colorless or light-colored basic dye and a color developer capable of reacting with the dye to form a color, characterized in that a coating solution of the intermediate layer contains a latex having a characteristic of gelling at a certain temperature (temperature-sensitive gelling characteristic) and the coating solution of the intermediate layer has a pH of 7.0 or more and the temperature of the coating solution at the time of preparation and coating is lower than the gelling temperature of the temperature-sensitive latex by 20° C. or more.

(6) A method for producing a heat-sensitive recording material as described in (5), characterized in that temperature of a coat layer just after coating the coating solution of the intermediate layer on the support is not lower than the gelling temperature of the temperature-sensitive latex contained in the coating solution by 20° C. or more.

(7) A method for producing a heat-sensitive recording material as described in (6), characterized in that the temperature-sensitive latex contained in the coating solution is rapidly gelled by heating the support just before coated with the coating solution using a heating means, by heating the coating layer of the coating solution just after formed or by combination of these heating methods.

(8) A method for producing a heat-sensitive recording material as described in (7), characterized in that the coating means is blade coating.

(9) A method for producing a heat-sensitive recording material as described in (7), characterized in that the coating means is on-machine coating.

BEST MODE FOR CARRYING OUT THE INVENTION

The present invention will be explained in detail.

The inorganic or organic pigments used in the intermediate layer include those for general paper making and coating. Examples are inorganic fine powders such as clay, calcium carbonate, magnesium carbonate, talc, silica, porous silica, kaolin, calcined kaolin, diatomaceous earth, synthetic aluminum silicate, zinc oxide, titanium oxide, aluminum hydroxide, barium sulfate and surface-treated calcium carbonate and silica, and organic resin fine powders such as urea-formalin resin, styrene/methacrylic acid copolymer and polystyrene resin. Porous calcined clay and porous silica are preferred.

Image density and sensitivity are further improved by using fine hollow particles in the intermediate layer. The fine hollow particles used in the intermediate layer include ① those obtained by expanding thermally expandable fine spheres, ② glass fine hollow powder and ③ aluminosilicate fine hollow powder. These fine hollow particles have a particle size in the range of 0.3–200 μm, and when they are used in the intermediate layer, the particle size is 5 μm or less, preferably 0.4–1 μm.

The temperature-sensitive latexes used in the present invention are those which gel at a temperature higher than a certain specific temperature, being different from usual SBR. It is considered that since they have the characteristic of gelling with application of heat, gelation occurs at the time of drying before the formation of layer to hinder dense filling between pigment particles, and, hence, the coated layer becomes bulky to exhibit the heat insulation effect. The adhesion strength increases with decrease of the gelling temperature, but from the point of the preparation temperature of coating solution, if the gelling temperature is too low, preparation and coating of the coating solution become impossible. Therefore, the gelling temperature is usually 30–75° C., preferably 45–65° C.

Specifically, the latexes are those as described in JP-A-9-31138 and they are temperature-sensitive thickening latexes comprising an aqueous dispersion (C) of a water-insoluble polymer obtained by polymerizing a monomer (B) in the presence of a thermally reversible polymer (A) which reversibly changes in hydrophilicity and hydrophobicity at a certain temperature as a boundary therebetween.

As the thermally reversible polymer (A) which reversibly changes in hydrophilicity and hydrophobicity at a certain temperature as a boundary therebetween, mention may be made of, for example, a polymer (A1) comprising a vinylcarboxylate ester of an alkylene oxide adduct of a cyclic amine or a non-cyclic amine of 5 or more carbon atoms, a polymer (A2) comprising an N-alkyl, N-alkylene or N-alkoxyalkyl(meth)acrylamide, a polymer (A3) comprising a polyalkylene glycol monoalkyl ether mono(meth) acrylate or a polyalkylene glycol monophenyl ether mono (meth)acrylate, a polymer (A4) comprising a polyethylene glycol monoalkylmonovinyl ether, a polymer (A5) comprising polyethylene glycol monophenylmonovinyl ether, a polymer (A6) comprising a polyethylene glycol monoalkyl ether mono(vinylphenyl) ether, alkylene oxide adducts of methylcellulose, polyvinyl alcohol having a saponification degree of 70% or more, polyvinylmethyl ether and polyorganosiloxane, alkylene oxide adducts of alkylphenol formalin condensates, etc. Among them, (A1) and (A2) are preferred because temperature-sensitive gelation occurs sharply, and (A1) is especially preferred. The cyclic amine in the vinylcarboxylate ester (a1) which constitutes the polymer (A1) is not particularly limited as far as it has an active hydrogen for the addition of alkylene oxide, and, therefore, it may have an amine nitrogen on or outside the ring. The active hydrogen group may derive from amine group or may derive from any groups such as hydroxyl group and carboxyl group as long as alkylene oxide can add thereto.

As monomers constituting the monomer (B), there may be used known ones, and preferred are conjugated diene monomers (b1) and aromatic radical polymeric monomers (b2). The conjugated diene monomers (b1) include butadiene, isoprene, chloroprene, 2-methyl-1,3-butadiene, etc. Butadiene is especially preferred.

Content of (b1) in the water-insoluble polymer is preferably 20–60% by weight. If the content is less than 20% by weight, adhesion strength is insufficient when the resin latex is used as a binder for fibers and others, and if it exceeds 60% by weight, the formed film is inferior in endurance.

As the aromatic radical polymeric monomers (b2), mention may be made of styrene, α-methylstyrene, vinyltoluene, β-methylstyrene, vinylnaphthalene, etc. Among them, styrene is preferred.

Content of (b2) in the water-insoluble polymer is usually 10–80% by weight, preferably 20–60% by weight. If the content is less than 10% by weight, strength of the formed film of the resin latex is insufficient and if it exceeds 80% by weight, adhesion strength is inferior when the resin latex is used as a binder for fibers and others.

The process for producing the dispersion (C) is not limited. For example, mention may be made of a process which comprises adding dropwise a monomer mixture (B) to a mixture of water, thermally reversible polymer (A), polymerization initiator and additives at a temperature lower than the transition temperature of thermally reversible thickening agent (B). The gelling temperature can be changed by adjusting these components.

Resin content in the dispersion (C) is usually 20–75%, preferably 40–60%. Particle size of the polymer in (C) is usually 10–500 nm, preferably 50–300 nm. pH of (C) is generally 7.0 or more, usually 3–12, and preferably 6–10. If the particle size exceeds 500 nm or pH is less than 3 or more than 12, thickening property cannot be sufficiently exhibited.

The acrylic alkali thickening agent in the present invention comprises a polymer mainly composed of a non-crosslinking type alkali-soluble emulsion or a crosslinking type alkali-swellable emulsion and causes dissolution or swelling with addition of alkalis such as aqueous ammonia and sodium hydroxide and exhibits the effect to enhance viscosity or water retention of the coating solution by an action with a chemical bond of the polymer and water molecules (hydrogen bond) or a physical action of the polymer including water molecules. Especially, the non-crosslinking type acrylic alkali thickening agent comprising a polymer mainly composed of a non-crosslinking type alkali-soluble emulsion is preferred because it is stable in viscosity of coating solution, and exhibits the effect to provide very satisfactory viscosity of the coating solution and enhance water retention of the coating solution in combination with specific oil absorbing pigments having an oil absorption of 80 g/m$^2$ or more, such as calcined clay and porous silica or fine hollow particles.

Amount of the acrylic alkali thickening agent is adjusted considering characteristics of the intermediate layer and coating suitability. In the case of the non-crosslinking type acrylic alkali thickening agent, the amount is 0.05–5 parts by weight, preferably 0.08–3 parts by weight for 100 parts by weight of the pigments of the intermediate layer. If the amount is less than 0.05 part by weight, thickening effect is small and coating suitability is not improved. Moreover, the effect of film characteristics are not obtained. If it is more than 5 parts by weight, viscosity of the coating solution considerably increases, and feeding and circulation of the coating solution become impossible. No further improvement of the film characteristics can be expected.

Migration of the binder in the intermediate layer is inhibited by adding the acrylic alkali thickening agent to the intermediate layer, and when a heat-sensitive recording layer or an overcoat layer is laminated on the intermediate layer, the materials in these layers, such as binder and pigment are uniformly distributed, resulting in good image reproducibility and whiteness, and furthermore the film characteristics of the overcoat layer can also be improved.

Since the acrylic alkali thickening agent used in the present invention is an emulsion type thickening agent, it can be easily added to the coating solution and has no septicity like natural products, and moreover coating solution of high concentration can be prepared because of relatively low solid concentration. In addition, since it is superior to usual thickening agents in the effect to improve water retention of the coating solution, coating solutions suitable especially for high concentration blade coating can be prepared.

As thickening agents for coating solutions not intended for the present invention, there are known, for example, sodium alginate, carboxymethylcellulose and methylcellulose, but these are generally septic and non-uniformly dissolved in preparation and are not preferred in operation.

Furthermore, polyol compounds having hydroxyl group in the molecule, such as ethylene glycol, glycerin and polyethylene glycol of low polymerization degree can be added as subsidiary components to the acrylic alkali thickening agents comprising polymers mainly composed of alkali-soluble emulsions in order to hasten the rising of increase of viscosity of coating solution, obtain stable thickening effect or water retaining effect and further improve the film characteristics for inhibition of incorporation of the components into heat-sensitive recording layer. Amount of these subsidiary components is desirably adjusted in the range of about 20–40 parts by weight for 100 parts of the acrylic alkali thickening agent which is a main component.

As for temperature for the preparation of the coating solution and temperature of the solution at the time of coating, the temperature of the solution must be lower than the gelling temperature since latex has temperature-sensitive gelling characteristic, but it is preferred to carry out preparation and coating of the solution at a temperature lower than the gelling temperature of latex by 20° C. or more. If the temperature is lower than the gelling temperature by less than 20° C., sometimes gelation is gradually brought about during preparation, and the solution property becomes thixotropic, fluidity is unstable and coating cannot be performed stably.

The pH at the time of preparation of the intermediate layer must be 7.0 or more, and is preferably 7.0–10, more preferably 7.5–9.5. If pH of the coating solution is less than 7.0, fluidity is inferior and the coating solution cannot be stably feeded at the time of coating to cause thin spot. If pH is more than 10, the alkalinity improves whiteness of heat-sensitive recording material, but causes deterioration of preservability and recording sensitivity.

The pH is adjusted by adding aqueous ammonia or sodium hydroxide or other pH adjustors.

Furthermore, when acrylic alkali thickening agent is added, pH must be 7.0 or more, preferably 7.2 or more, and unless the pH is 7.0 or more, no stable thickening effect can be obtained to cause problems in coating suitability.

Coating amount of the intermediate layer can be adjusted depending on the kind of pigment used in the intermediate layer, concentration of the coating solution, the kind of coating head, and the like. For example, when the coating solution containing calcined clay is coated by a blade, the wet coating amount is preferably 10–16 g/m$^2$ with 13 g/m$^2$ as the central value, and the solid coating amount is preferably 4–7 g/m$^2$ with 6 g/m$^2$ as the central value. When fine hollow particles are used, the wet coating amount is preferably 16–23 g/m$^2$ with 20 g/m$^2$ as the central value, and the solid coating amount is preferably 4–7 g/m$^2$ with 6 g/m$^2$ as the central value.

Coating amount of the intermediate layer is determined considering characteristics of the support, sensitivity of the heat-sensitive layer and smoothness for head, and is preferably 3–10 g/m$^2$ in terms of solid content.

Concentration of the coating solution is determined depending mainly on the coating head, the coating amount, the drying load, and the kind of support. For example, it is 40–55%, preferably 45–53% in the case of blade coating, 20–40%, preferably 25–35% in the case of air knife coating, and 35–50%, preferably 38–45% in the case of rod coating.

The coating solution which constitutes the intermediate layer of the present invention is suitable for rod coating and blade coating, and especially suitable for blade coating.

The colorless or light-colored basic dyes which constitute the recording layer of the heat-sensitive recording materials of the present invention are used each alone or in admixture of two or more. As the basic dyes, those which are used in the heat-sensitive materials of this kind are optionally used, and, for example, leuco compounds such as triarylmethane dyes, fluoran dyes, thiazine dyes, spiropyran dyes and lactam dyes. Particularly, fluoran leuco dyes are widely used, and examples of the dyes are mentioned below.

Triarylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1, 2-dimethylindol-3-yl)phthalide, 3-(p-dimethylaminophenyl)-3-(2-methylindol-3-yl)-5-dimethylaminophthalide, 3,3-bis(2-phenylindol-3-yl)-dimethylaminophthalide and 3-p-dimethylaminophenyl-3-(1-methylpyrrol-3-yl)-6-dimethylaminophthalide, fluoran dyes such as 6'-[ethyl(3-methylbutyl)amino]-3'-methyl-2'-(phenylamino)-spiro[isobenzylfuran-1,9'-xanthene]-3-one, 3-dibutylamino-6-methyl-7-anilinofluoran, 3-(N-methyl-N-propylamino)-6-methyl-7-anilinofluoran, 3-(N-cyclohexyl-N-methylamino)-6-methyl-7-anilinofluoran, 3-dimethylamino-6-methyl-7-chlorofluoran, 3-dimethylamino-7-methyl-7-chlorofluoran, 3-dimethylamino-6-methyl-7-anilinofluoran, 3,3-bis(4-dimethylaminophenyl)-6-diethylaminophthalide, 3-diethylamino-7-(2-chloroanilino)fluoran and 3-dibutylamino-7-(2-chloroanilino)fluoran, thiazine dyes such as benzoyl leucomethylene blue and p-nitrobenzoyl leucomethylene blue, spiropyran dyes such as 3-methyl-spiro-dinaphthopyran, 3-phenyl-spiro-dinaphthopyran, 3-benzyl-spiro-dinaphthopyran, 3-methyl-naphtho-(6'-methoxybenzo)spiropyran and 3-propyl-spiro-dibenzopyran, and lactam dyes such as rhodamine (p-nitroanilino)lactam and rhodamine (o-chloroanilino) lactam.

Binders contained in the heat-sensitive color forming layer bonded to and supported on the intermediate layer include various ones as enumerated below.

Water-soluble polymers such as polyvinyl alcohol, starch and derivatives thereof, cellulose derivatives, e.g., methylcellulose, hydroxymethylcellulose, carboxymethylcellulose and ethylcellulose, polyvinyl pyrrolidone, polyacrylamide, sodium polyacrylate, acrylamide/acrylate copolymer, acrylamide/acrylate/methacrylic acid terpolymer, alkali salts of styrene/maleic anhydride copolymer, alkali salts of isobutylene/maleic anhydride copolymer, sodium alginate, gelatin, casein and gum arabic, and, in addition, aqueous emulsions such as polyvinyl acetate, polyurethane, polyacrylic acid, polyacrylate, polymethacrylate, vinyl chloride/vinyl acetate copolymer, ethylene/vinyl acetate copolymer and polybutyl methacrylate.

In the heat-sensitive recording materials of the present invention, the heat-sensitive color forming layer may optionally contain conventional subsidiary additive components ordinarily used for heat-sensitive recording materials of this kind, such as filler, surface active agent, lubricant, and the like, together with the above-mentioned leuco dyes and color developers. Examples of the filler are inorganic fine powders such as calcium carbonate, silica, alumina, magnesium, talc, barium sulfate, zinc oxide, titanium oxide, surface-treated calcium and silica, and organic fine powders such as urea/formalin resin, styrene/methacrylic acid copolymer and polystyrene. Examples of the lubricant are esters, amides or metal salts of higher fatty acids, and, besides, various waxes, condensates of aromatic carboxylic acids and amines, phenyl benzoate, higher straight chain glycols and other heat-meltable organic compounds. Furthermore, fine powders such as aluminum stearate can be added to improve sharpness of color images, and lubricants such as lineseed oil, tung oil, waxes, paraffins, polyethylene wax, paraffin chloride and metal salts of higher fatty acids can be added to further improve running property of thermal head.

Coating amount of the heat-sensitive recording layer is not limited, but usually is 3–15 g/m$^2$, preferably 4–10 g/m$^2$ in terms of solid matter.

In the present invention, an overcoat layer can also be provided for the purpose of protection of the recording layer, and, furthermore, a protective layer can also be provided on the back side of the support. Moreover, various known techniques in the field of production of heat-sensitive recording materials, such as tackifying treatment of the back side of the support can be applied to the heat-sensitive recording material of the present invention.

The overcoat layer mainly composed of binders such as PVA and acryl emulsion is provided for improving chemical resistance and scratch resistance, and coating amount is 0.5–5.0 g/m$^2$, preferably 1.0–3.0 g/m$^2$. The overcoat layer can be constructed in the form of multilayer. Furthermore, lubricants, pigments and the like can be optionally added for the purpose of inhibition of sticking or the like.

The support is generally paper, and resin films, synthetic papers, nonwoven fabrics and the like can also be used. Especially when the support is paper, the intermediate layer according to the present invention is particularly effective.

Apparatuses used for coating the intermediate layer, the heat-sensitive recording layer and the over-coat layer include coater heads such as blade coater, air knife coater, roll coater, rod coater and curtain coater.

In providing the intermediate layer on a support, when the temperature of the coat in wet state just after coated on the support is not lower, by 20° C. or more, than the gelling temperature of the temperature-sensitive latex contained in the coating solution, the coating solution can be prevented from penetrating into the support especially in the case of the support being a porous one such as paper or non-woven fabric, and an intermediate layer having further smoothness and better film property can be formed. More preferably, the temperature of the coat just after coated is not lower, by 10° C. or more, than the gelling temperature of the temperature-sensitive latex, and further preferably, it is higher than the gelling temperature.

For this purpose, the temperature-sensitive latex contained in the coating solution can be rapidly gelled by heating the support just before coated with the coating solution by a heating means, by heating the coat just after coated, or by the combination of these heating methods.

For example, there are a method of applying heat to the support per se just before a coating device by direct heating with an infrared dryer, a gas dryer, a conventional dryer, a heating roll, an induction heating device or the like, and, thereafter, coating the coating solution and then drying the coat, a method of increasing the temperature of the surface of the coat on the support utilizing heat conduction by using a heating roll as backing roll opposing the coating head, and a method of heating the coating solution per se just after coated on the support to a temperature of rapid gelation by an infrared dryer, a gas dryer, a heating roll or an induction heating device before drying by conventional dryers, thereby to accelerate the gelation to inhibit closest packing and then evaporating only water. There can be used one or two or more of these methods in combination.

When coating is carried out on-machine, the gelation can be efficiently accelerated since the support passes through a dryer of paper machine and hence the surface temperature of the support is high.

In this case, the gelation can also be efficiently accelerated by heating with an infrared dryer, a gas dryer, a heating roll or an induction heating device just after on-machine coating.

EXAMPLE

The following examples are intended to explain the present invention in more detail, but they are not intended to limit the invention in any way. All parts and percentages are by weight.

EXAMPLE 1

[Preparation of intermediate layer I]

| | |
|---|---|
| Water | 107 parts by weight |
| 10% Sodium hexametaphosphate | 8 parts by weight |
| Calcined kaolin (Trade name: ANSILEX manufactured by ENGELHARD Co. Ltd.) | 100 parts by weight |
| 25% Oxidized starch solution | 24 parts by weight |
| 48% Latex (SD-101 manufactured by Sanyo Kasei Co., Ltd., gelling temperature 60° C.) | 25 parts by weight |
| 5% Sodium hydroxide | 1.5 part by weight |

The above components were mixed with keeping a constant temperature of 30° C. to prepare intermediate layer coating solution I of 45% in solid content.

[Formation of intermediate layer]

The resulting intermediate layer coating solution was coated at a coating amount of 6 g/m$^2$ onto a base paper of 50 g/m$^2$ at a solution temperature of 30° C. by a blade coater and dried by dryer (set at 140° C.) to form an intermediate layer.

[Preparation of heat-sensitive layer]

(1) Preparation of coating solution A

Coating solution A and coating solution B of the following composition were obtained by dispersing for 10 hours.

| | |
|---|---|
| 10% Polyvinyl alcohol solution | 100 parts by weight |

-continued

| | |
|---|---|
| 3-Dibutylamino-6-methyl-7-anilinofluoran | 100 parts by weight |
| Water | 150 parts by weight |

The coating solution A was ground to an average volumetric particle size of 1.5 μm by Dyno-mill (manufactured by Shinmaru Enterprises Corporation).

(2) Preparation of coating solution B

| | |
|---|---|
| 15% Styrene-maleic anhydride copolymer ammonium salt | 35 parts by weight |
| 4,4-Isopropylidenediphenol | 55 parts by weight |
| 2-Benzyloxy-naphthalene | 40 parts by weight |
| N-methylolstearic acid amide | 10 parts by weight |
| Water | 200 parts by weight |

The coating solution B was ground to an average volumetric particle size of 1.5 μm by Dyno-mill (manufactured by Shinmaru Enterprises Corporation).

[Formation of heat-sensitive layer]

Then, a coating solution for heat-sensitive color forming layer comprising the following components was prepared using the resulting solutions A and B. The resulting coating solution was dry-coated at a dry coating weight of 5 g/m$^2$ on the above under layer at a rate of 300 m/min by an air knife coater. Then, this coated paper was subjected to calendering to give a Beck smoothness of 400–600 seconds, and, thus, the heat-sensitive recording material of the present invention was obtained.

| | |
|---|---|
| Polyvinyl alcohol solution (10% aqueous solution) | 50 parts by weight |
| Calcium carbonate | 10 parts by weight |
| Solution A | 10 parts by weight |
| Solution B | 35 parts by weight |
| 40% Zinc stearate dispersion | 4 parts by weight |
| Water | 25 parts by weight |

EXAMPLE 2

Example 1 was repeated, except that components of the intermediate layer I was changed as shown below.

[Preparation of intermediate layer II]

| | |
|---|---|
| Water | 107 parts by weight |
| 10% Sodium hexametaphosphate | 8 parts by weight |
| Calcined kaolin (Trade name: ANSILEX manufactured by ENGELHARD Co., Ltd.) | 80 parts by weight |
| Calcium carbonate | 20 parts by |

-continued

| | |
|---|---|
| | weight |
| 25% Oxidized starch solution | 24 parts by weight |
| 48% Latex (Trade name: SD-101 manufactured by Sanyo Kasei Co., Ltd., gelling temperature 60° C.) | 25 parts by weight |
| 5% Sodium hydroxide | 0.8 part by weight |

The above composition was mixed with keeping a constant temperature of 30° C. to prepare a coating solution for the intermediate layer II of 45% in solid content.

EXAMPLE 3

[Preparation of overcoat solution]

| | |
|---|---|
| Water | 115 parts by weight |
| 5% PVA (Trade name: PVA117 manufactured by Kuraray Co., Ltd.) | 100 parts by weight |
| 20% Acryl emulsion resin (Trademark: OM1050 manufactured by Mitsui Toatsu Chemicals, Inc.) | 50 parts by weight |
| Fine powder silicic acid (Trademark: MIZUKASIL P527 manufactured by Mizusawa Kagaku Co., Ltd.) | 10 parts by weight |
| 40% Zinc stearate dispersion | 5 parts by weight |

The above composition was mixed to prepare a coating solution for overcoat layer.

[Formation of overcoat layer]

The resulting coating solution for overcoat layer was coated at a coating amount of 2 g/m$^2$ on the heat-sensitive recording layer formed in Example 1 and was dried. Then, the coated paper was subjected to calendering to give a Beck smoothness of 700–1000 seconds.

EXAMPLE 4

Example 1 was repeated, except that composition of the intermediate layer I was changed as shown below.

[Intermediate layer III]

| | |
|---|---|
| Water | 100 parts by weight |
| 30% Fine hollow particle dispersion (Trademark: OP62 manufactured by Rohm & Haas Co., particle size: 0.45 μm) | 300 parts by weight |
| 25% Oxidized starch solution | 24 parts by weight |
| 48% Latex (Trade name: SD-101 manufactured by Sanyo Kasei Co., Ltd., gelling temperature 60° C.) | 25 parts by weight |

The above composition was mixed with keeping a constant temperature of 30° C. to prepare a coating solution for the intermediate layer III of 28% in solid content.

EXAMPLE 5

Example 1 was repeated, except that composition of the intermediate layer I was changed as shown below.

[Intermediate layer IV]

| | |
|---|---|
| Water | 100 parts by weight |
| 30% Fine hollow particle dispersion (Trademark: HP91 manufactured by Rohm & Haas Co., particle size: 1 μm) | 300 parts by weight |
| 25% Oxidized starch solution | 24 parts by weight |
| 48% Latex (Trade name: SD-101 manufactured by Sanyo Kasei Co., Ltd., gelling temperature 60° C.) | 26 parts by weight |

The above composition was mixed with keeping a constant temperature of 30° C. to prepare a coating solution for the intermediate layer IV of 28% in solid content.

EXAMPLE 6

Example 1 was repeated, except that 0.1 part of a 30% non-crosslinking type acrylic alkali thickening agent (Trademark: SN THICKENER 920 manufactured by Sun Nopco Co., Ltd.) was added to the composition of the intermediate layer I and the solid content was 43%.

As a result, formation of streaks was less than in Example 1, and profile was superior.

EXAMPLE 7

Example 1 was repeated, except that 0.05 part of a 30% non-crosslinking type acrylic alkali thickening agent (Trademark: SN THICKENER 920 manufactured by Sunnopco Ltd.) was added to the composition of the intermediate layer I and the solid content was 40%.

As a result, as compared with Example 1, formation of streaks was less, profile was superior, and whiteness and print density of the coated heat-sensitive layer were improved.

EXAMPLE 8

Example 1 was repeated, except that 5 parts of a 30% non-crosslinking type acrylic alkali thickening agent (Trademark: SN THICKENER 922 manufactured by Sunnopco Ltd.) was added to the composition of the intermediate layer I and the solid content was 40%.

As a result, as compared with Example 1, formation of streaks was less, profile was superior, and whiteness and print density of the coated heat-sensitive layer were improved.

EXAMPLE 9

Example 3 was repeated, except that 0.1 part of a 30% non-crosslinking type acrylic alkali thickening agent (Trademark: SN THICKENER 920 manufactured by Sunnopco Ltd.) was added to the composition of the intermediate layer I and the solid content was 43%.

As a result, as compared with Example 3, film properties after formation of the overcoat were improved, and, furthermore, print density was also improved.

EXAMPLE 10

Example 4 was repeated, except that 0.1 part of a 30% non-crosslinking type acrylic alkali thickening agent (Trademark: SN THICKENER 920 manufactured by Sunnopco Ltd.) was added to the composition of the intermediate layer III and the solid content was 43%.

As a result, as compared with Example 4, formation of streaks was less, profile was superior, and whiteness and print density of the coated heat-sensitive layer were improved.

EXAMPLE 11

Example 5 was repeated, except that 0.1 part of a 30% non-crosslinking type acrylic alkali thickening agent (Trademark: SN THICKENER 920 manufactured by Sunnopco Ltd.) was added to the composition of the intermediate layer IV and the solid content was 43%.

As a result, as compared with Example 5, formation of streaks was less, profile was superior, and whiteness and print density of the coated heat-sensitive layer were improved.

EXAMPLE 12

Example 1 was repeated, except that the preparation temperature of the intermediate layer I and the solution temperature at coating were 40° C.

EXAMPLE 13

Example 1 was repeated, except that the amount of sodium hydroxide in the intermediate layer I was 1.0 part by weight.

EXAMPLE 14

Example 1 was repeated, except that just after the intermediate layer was coated by a blade coater, the coated paper was passed through an infrared dryer set at 100° C. (based on the surface temperature of uncoated paper) and thereafter dried by a dryer (set at 140° C.).

As a result, the print density was improved than in Example 1.

EXAMPLE 15

Example 1 was repeated, except that just before the intermediate layer was coated by a blade coater, the support was directly heated by an infrared dryer (set at 100° C.) and thereafter the intermediate was formed in the same manner as in Example 1.

As a result, the print density was improved than in Example 1.

COMPARATIVE EXAMPLE 1

Example 1 was repeated, except that the temperature-sensitive latex in the composition of the intermediate layer I was changed to a 48% styrene butadiene latex (Trademark: CROSREN 130 manufactured by Takeda Chemical Industries, Ltd).

COMPARATIVE EXAMPLE 2

Example 2 was repeated, except that the temperature-sensitive latex in the composition of the intermediate layer II was changed to a 48% styrene butadiene latex (Trademark: CROSREN 130 manufactured by Takeda Chemical Industries, Ltd).

COMPARATIVE EXAMPLE 3

Example 3 was repeated, except that the temperature-sensitive latex in the composition of the intermediate layer I was changed to a 48% styrene butadiene latex (Trademark: CROSREN 130 manufactured by Takeda Chemical Industries, Ltd).

COMPARATIVE EXAMPLE 4

Example 1 was repeated, except that the preparation temperature of the intermediate layer I was changed to 45° C. As a result, gelation occurred during preparation and the coating solution could not be prepared.

COMPARATIVE EXAMPLE 5

Example 1 was repeated, except that the solution temperature at coating of the intermediate layer I was changed to 45° C. The coating solution gelled during coating, and coating was impossible.

COMPARATIVE EXAMPLE 6

Example 1 was repeated, except that the intermediate layer was prepared without the addition of sodium hydroxide.

As a result, since pH was too low, gelation occurred during preparation of the coating solution, and coating was impossible.

COMPARATIVE EXAMPLE 7

Example 1 was repeated, except that the amount of sodium hydroxide in the composition of the intermediate layer I was 3 parts by weight.

As a result, since pH was too high, print density of the heat-sensitive paper was low and, besides, storage characteristic was inferior.

COMPARATIVE EXAMPLE 8

Example 1 was repeated, except that 0.03 part of a 30% non-crosslinking type acrylic alkali thickening agent (Trademark: SN THICKENER 920 manufactured by Sun Nopco Co., Ltd.) was added to the composition of the intermediate layer I and the solid content was 43%.

The results were similar to those of Example 1, and the effect of the thickening agent was not seen.

COMPARATIVE EXAMPLE 9

Example 1 was repeated, except that 6.0 parts of a 30% non-crosslinking type acrylic alkali thickening agent (Trademark: SN THICKENER 920 manufactured by Sunnopco Ltd.) was added to the composition of the intermediate layer I and the solid content was 43%.

As a result, viscosity abruptly increased and feeding of the coating solution became impossible, and thus coating of the coating solution was impossible.

COMPARATIVE EXAMPLE 10

Example 1 was repeated, except that 0.35 part of carboxymethylcellulose (Trademark: CELLOGEN WS-C manufactured by Dai-ichi Kogyo Seiyaku Co., Ltd.) was added to the composition of the intermediate layer I and the solid content was 40%.

As a result, many streaks were formed to deteriorate property of the surface and profile was inferior, and stable production was impossible.

COMPARATIVE EXAMPLE 11

Example 5 was repeated, except that the 48% temperature-sensitive latex of the intermediate layer III was changed to a 48% styrene butadiene latex (Trademark: CROSREN 130 manufactured by Takeda Chemical Industries, Ltd).

COMPARATIVE EXAMPLE 12

Example 7 was repeated, except that the 48% temperature-sensitive latex of the intermediate layer IV was changed to a 48% styrene butadiene latex (Trademark: CROSREN 130 manufactured by Takeda Chemical Industries, Ltd).

The thus prepared 25 intermediate layer coating solutions and heat-sensitive recording materials were evaluated by the following methods and the results are shown in Tables 1 and 2.

Evaluation of the intermediate layers:

1: pH of coating solution—The pH of the coating solutions of the intermediate layers prepared was measured by a pH meter.

2: Preparation of coating solutions—Easiness in preparation of the coating solutions was visually evaluated based on the following evaluation criteria.

At least the criterion "○" is required.

◎: Preparation is very easy.

○: Preparation is relatively easy.

Δ: Preparation is somewhat difficult.

×: Preparation is difficult.

-: Gelation occurs and preparation is impossible.

3: Coating suitability—Blade coating suitability was visually evaluated on troubles due to line scars such as streaks and troubles of detritus caused by insufficient transfer of the coating solution to applicator roll in accordance with the following criteria. At least the criterion "○" is required.

◎: Substantially no troubles occur.

○: Some troubles occur depending on the conditions.

Δ: Problems occur in production due to occurrence of troubles.

Δ: Troubles occur frequently and there are problems in quality.

-: Gelation of the coating solution occurs and coating is impossible.

4: High-shear viscosity

This was measured by a Hercules type high-shear viscometer (NRM 100 manufactured by Japan Rheology Apparatus Co., 3000 rpm). Solutions before coating and after coating were taken and their viscosity was measured. Solutions having smaller difference in viscosity before and after coating are stabler solutions.

Evaluation of heat-sensitive recording material

1: Whiteness—Reflectance was measured by Hunter reflectance meter using an amber filter in accordance with JIS-P8123. The greater value means the higher whiteness, and at least 85% is necessary.

2: Print density—Printing was carried out sing a heat-sensitive facsimile printing tester (manufactured by Ohkura Electric Co., Ltd., with a head having a head resistance of 1335 Ω) under the condition of 0.67 mJ in applied energy, and print density of the resulting image portion was measured. The print density was measured by Macbeth RD 918. Overcoated heat-sensitive papers require at least 1.0, and others require 1.1 or more.

When preparation and coating were impossible, evaluation of the heat-sensitive recording materials was not conducted.

TABLE 1

| | Suitability of | | | High-shear viscosity | | | |
|---|---|---|---|---|---|---|---|
| | pH of coating solution | preparation of coating solution | Coating suitability | Before coating cps | After coating cps | Whiteness % | Print density |
| Example 1 | 8.0 | ○ | ○ | 145 | 131 | 85.5 | 1.17 |
| Example 2 | 8.0 | ○ | ○ | 146 | 137 | 85.6 | 1.15 |
| Example 3 | 8.0 | ○ | ○ | 145 | 132 | 85.2 | 1.05 |
| Example 4 | 8.0 | ◎ | ○ | 13 | 10 | 86.3 | 1.28 |
| Example 5 | 8.0 | ◎ | ◎ | 37 | 30 | 87.8 | 1.31 |
| Example 6 | 8.0 | ○ | ◎ | 148 | 146 | 86.8 | 1.21 |
| Example 7 | 8.0 | ○ | ◎ | 147 | 140 | 86.8 | 1.20 |
| Example 8 | 8.0 | ◎ | ○ | 151 | 149 | 86.7 | 1.21 |
| Example 9 | 8.0 | ○ | ○ | 145 | 132 | 86.2 | 1.08 |
| Example 10 | 8.9 | ◎ | ◎ | 14 | 13 | 87.1 | 1.33 |
| Example 11 | 8.8 | ◎ | ◎ | 38 | 35 | 88.3 | 1.37 |
| Example 12 | 8.0 | ○ | ○ | 145 | 131 | 85.3 | 1.17 |
| Example 13 | 7.1 | ○ | ○ | 144 | 130 | 85.2 | 1.17 |
| Example 14 | 8.6 | ○ | ○ | 145 | 131 | 85.2 | 1.21 |
| Example 15 | 8.6 | ○ | ○ | 145 | 131 | 85.2 | 1.20 |

TABLE 2

| | Suitability of | | | High-shear viscosity | | | |
|---|---|---|---|---|---|---|---|
| | pH of coating solution | preparation of coating solution | Coating suitability | Before coating cps | After coating cps | Whiteness % | Print density |
| Comparative Example 1 | 6.9 | Δ | Δ | 151 | 132 | 83.3 | 1.05 |
| Comparative Example 2 | 7.1 | Δ | Δ | 149 | 131 | 83.6 | 1.03 |

TABLE 2-continued

| | Suitability of | | | High-shear viscosity | | | |
|---|---|---|---|---|---|---|---|
| | pH of coating solution | preparation of coating solution | Coating suitability | Before coating cps | After coating cps | Whiteness % | Print density |
| Comparative Example 3 | 6.9 | Δ | Δ | 151 | 133 | 82.8 | 0.95 |
| Comparative Example 4 | 8.6 | x | — | — | — | — | — |
| Comparative Example 5 | 8.6 | ○ | x | — | — | — | — |
| Comparative Example 6 | 6.8 | x | — | — | — | — | — |
| Comparative Example 7 | 10.8 | ○ | Δ | 142 | 130 | 86.8 | 1.03 |
| Comparative Example 8 | 8.0 | ○ | Δ | 148 | 133 | 85.2 | 1.16 |
| Comparative Example 9 | 8.0 | x | — | — | — | — | — |
| Comparative Example 10 | 8.1 | x | x | 152 | 141 | 83.6 | 1.14 |
| Comparative Example 11 | 9.1 | ⊙ | x | 11 | 10 | 83.6 | 1.18 |
| Comparative Example 12 | 9.2 | ⊙ | x | 11 | 11 | 83.8 | 1.19 |

As shown in Tables, heat-sensitive recording materials of high sensitivity comprising a support and a recording layer between which an intermediate layer is provided could be obtained by using a latex having a temperature-sensitive gelling characteristic as an adhesive and by adjusting pH of the coating solution for the intermediate layer to 7.0 or more and the temperature of the coating solution at the time of preparation and production the recording material to a temperature lower at least 20° C. than the gelling temperature. Furthermore, when a non-crosslinking type acrylic alkali thickening agent is added to the coating solution for the intermediate layer, heat-sensitive recording materials of high whiteness and very high printability can be obtained.

INDUSTRIAL APPLICABILITY

As mentioned above, heat-sensitive recording materials of high sensitivity comprising a support and a recording layer between which an intermediate layer is provided could be obtained by using a latex having a temperature-sensitive gelling characteristic as an adhesive and by adjusting pH of the coating solution for the intermediate layer to 7.0 or more and the temperature of the coating solution at the time of preparation and production the recording material to a temperature lower at least 20° C. than the gelling temperature. Furthermore, when a non-crosslinking type acrylic alkali thickening agent is added to the coating solution for the intermediate layer, heat-sensitive recording materials of high whiteness and very high printability could be obtained.

I claim:

1. A heat-sensitive recording material which comprises a support and, provided thereon, a heat-sensitive recording layer comprising a colorless or light colored basic dye and a color developer capable of reacting with the dye to form a color, an intermediate layer containing an inorganic or organic pigment being provided between the support and the recording layer, characterized in that a binder of the intermediate layer contains a latex which gels at a first specific temperature and comprises an aqueous dispersion of a water insoluble polymer obtained by polymerizing a monomer in the presence of a thermally reversible polymer which reversibly changes in hydrophilicity and hydrophobicity at a second specific temperature and a coating solution of the intermediate layer has a pH of 7.0 or more at the time of being coated.

2. A heat-sensitive recording material according to claim 1, wherein the intermediate layer contains 0.05–5 parts by weight of an acrylic alkali thickening agent for 100 parts by weight of the pigment in the intermediate layer.

3. A heat-sensitive recording material according to claim 1, wherein the pigment in the intermediate layer comprises fine hollow particles.

4. A heat-sensitive recording material of according to claim 1, wherein at least one overcoat layer is provided on the heat-sensitive recording layer.

5. A method for producing a heat-sensitive recording material which comprises coating an intermediate layer on a support and providing thereon, a heat-sensitive recording layer comprising a colorless or light colored basic dye and a color developer capable of reacting with the dye to form a color, characterized in that a coating solution of the intermediate layer contains a latex which gels at a first specific temperature and comprises an aqueous dispersion of a water insoluble polymer obtained by polymerizing a monomer in the presence of a thermally reversible polymer which reversibly changes in hydrophilicity and hydrophobicity at a second specific temperature, the coating solution of the intermediate layer has a pH of 7.0 or more, and the temperature of the coating solution at the time of preparation and coating is lower at least 20° C. than the gelling temperature of the latex which gels at said first specific temperature.

6. A method for producing a heat-sensitive recording material according to claim 5, wherein temperature of a coating layer of the intermediate layer just after coated on the support is not lower at least 20° C. than the gelling temperature of the temperature-sensitive latex.

7. A method for producing a heat-sensitive recording material according to claim 6, wherein the temperature-sensitive latex contained in the coating solution is rapidly gelled by heating the support just before coated with the coating solution by a heating means, or by heating the coating layer just after formed, or by combination of these heating methods.

8. A method for producing a heat-sensitive recording material according to claim 5, wherein the coating means is blade coating.

9. A method for producing a heat-sensitive recording material according to claim 5, wherein the coating means is on-machine coating.

* * * * *